United States Patent [19]

Kneisel

[11] Patent Number: 4,594,819

[45] Date of Patent: Jun. 17, 1986

[54] ROOF FLASHING FOR USE WITH ROOF PLANKING

[76] Inventor: Joseph P. Kneisel, 188 S. Sidlee St., Thousand Oaks, Calif. 91360

[21] Appl. No.: 583,613

[22] Filed: Feb. 27, 1984

[51] Int. Cl.[4] ..... E04D 1/36

[52] U.S. Cl. ..... 52/60; 52/13; 52/276

[58] Field of Search ..... 52/11, 13, 58, 60, 15, 52/465, 466, 518, 469, 276, 277, 542

[56] References Cited

U.S. PATENT DOCUMENTS

| | | | |
|---|---|---|---|
| 205,188 | 6/1878 | Horrie | 52/466 |
| 2,227,583 | 1/1941 | Hoess | 52/13 |
| 2,428,361 | 10/1947 | Doe | 52/465 |
| 3,302,353 | 2/1967 | Pradal | 52/469 |
| 3,905,165 | 9/1975 | Kneisel | 52/276 |
| 4,366,656 | 1/1983 | Simpson | 52/520 |

FOREIGN PATENT DOCUMENTS

| | | | |
|---|---|---|---|
| 663390 | 12/1951 | United Kingdom | 52/469 |

*Primary Examiner*—John E. Murtagh

*Attorney, Agent, or Firm*—Edgar W. Averill, Jr.

[57] ABSTRACT

A fabricated sheet metal roof flashing assembly for weather proofing the junction of roof planks at a roof valley. The invention consists of a series of abutting pairs of flashing assemblies faced over the intersection of two areas of roof planks. The flashing assembly has an elongated U-shaped channel member which encompasses upwardly directed integrally formed walls of the two flashing segments.

4 Claims, 6 Drawing Figures

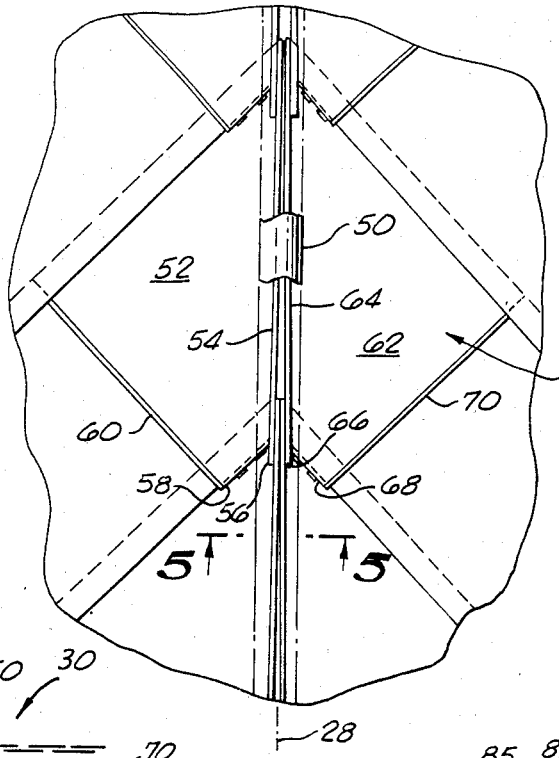
FIG. 3.
FIG. 5.
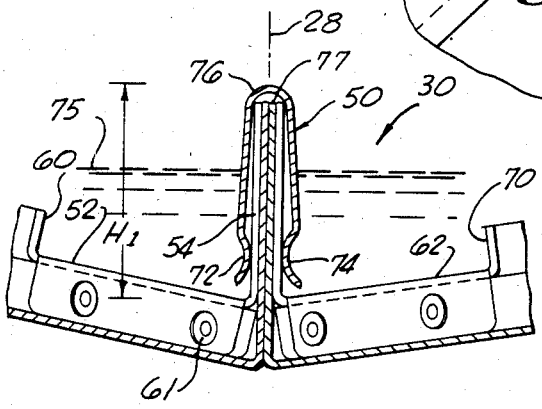
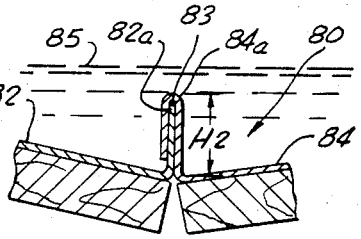
FIG. 6.
PRIOR ART
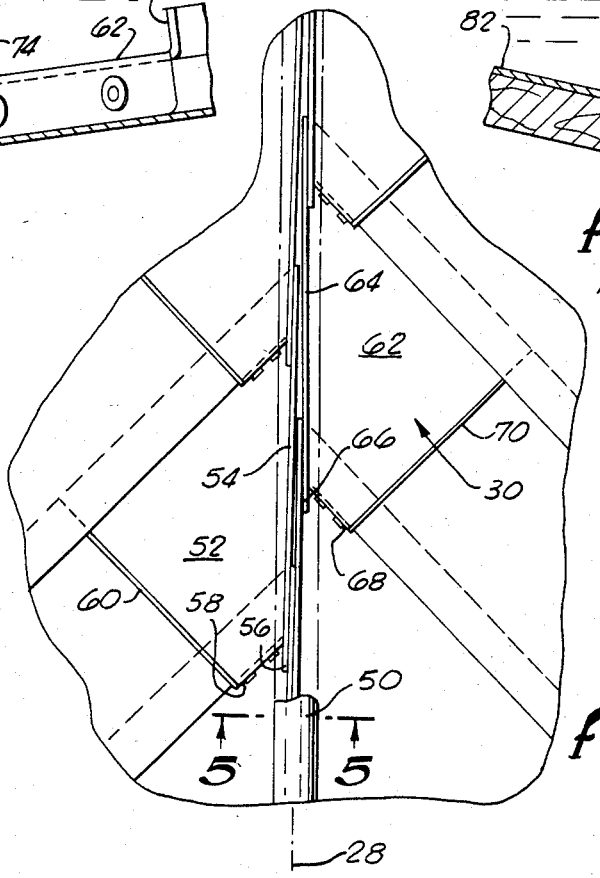
FIG. 4.

ROOF FLASHING FOR USE WITH ROOF PLANKING

BACKGROUND OF THE INVENTION

The field of the invention is roof flashing and the invention relates more particularly to roof flashing of the type useful with a roofing surface shown in applicant's U.S. Pat. No. 3,626,439. Roofing of this type will be referred to herein as "Roof Planking." One type of flashing useful with applicant's Roof Planking is disclosed in applicant's U.S. Pat. No. 3,905,165. This flashing is very effective for roof valleys when the rows of one roofing surface coincide with the rows of the intersecting roofing surface. For many installations, however, it is desirable or necessary that the rows do not intersect and an improved type of flashing is needed for such installations.

Conventional valley flashing cannot be employed with Roof Planking since conventional flashing is placed on top of the roof sheathing. Since Roof Planking does away with the need for sheathing, conventional flashing would not be useable.

Thus, there is a need for an improved roof flashing for use with Roof Planking.

SUMMARY OF THE INVENTION

It is an object of the present invention to provide roof flashing for weather proofing the valleys in a roof comprised of Roof Planking.

The present invention is for roof flashing installed on Roof Planking of the type which will form a weatherproof seal at roof valleys. The invention has first and second lengths of roofing board, each having an upper surface, a lower surface, a front longitudinal edge and an angled intersecting edge, and each board having its upper surface at a slight angle with respect to its lower surface. First and second flashing elements each have a first flat, roof-engaging surface abutting the upper surface of one of said lengths of roofing board at the intersecting edge thereof, each of said elements also having an integrally formed, downwardly-directed flange portion along one edge of said flat, roof-engaging surface and normal to said surface, said flange portion abutting said front edge of each of the roofing boards. Each flashing element has an upwardly directed elongated wall portion integrally formed with said flat, roof-engaging surface and at an edge adjacent said downwardly projecting flange portion and said wall portion lying along said intersecting edge of each of said roofing boards, the upper edge of said wall portion being parallel to the lower surface of the roofing board which it abuts and the upwardly directed wall portion of one flashing element abutting the upwardly directed wall portion of the other flashing element. An upwardly directed reinforcing wall is integrally formed with said flat roof-engaging surface at an edge of the flashing element which is opposite the upwardly directed elongated wall portion, the reinforcing extending from about the downwardly directed flange along a majority of the length of the edge of the flashing element but terminating at a point removed from the other adjacent edge of the flashing element. A generally U-shaped attaching element frictionally affixed over the intersection of the two upwardly directed elongated wall portions.

BRIEF DESCRIPTION OF THE DRAWINGS

FIG. 3 is a fragmentary plan view, with parts broken away, of a roof plank assembly incorporating the components of the present invention.

FIG. 4 is a view similar to FIG. 3, showing irregularly aligned rows of planking.

FIG. 5 is an enlarged fragmentary section through a typical valley as it is viewed along rows 5—5 of FIG. 3.

FIG. 6 is a fragmentary sectional view similar to FIG. 5 but showing prior art.

DESCRIPTION OF THE PREFERRED EMBODIMENTS

Figure 1:
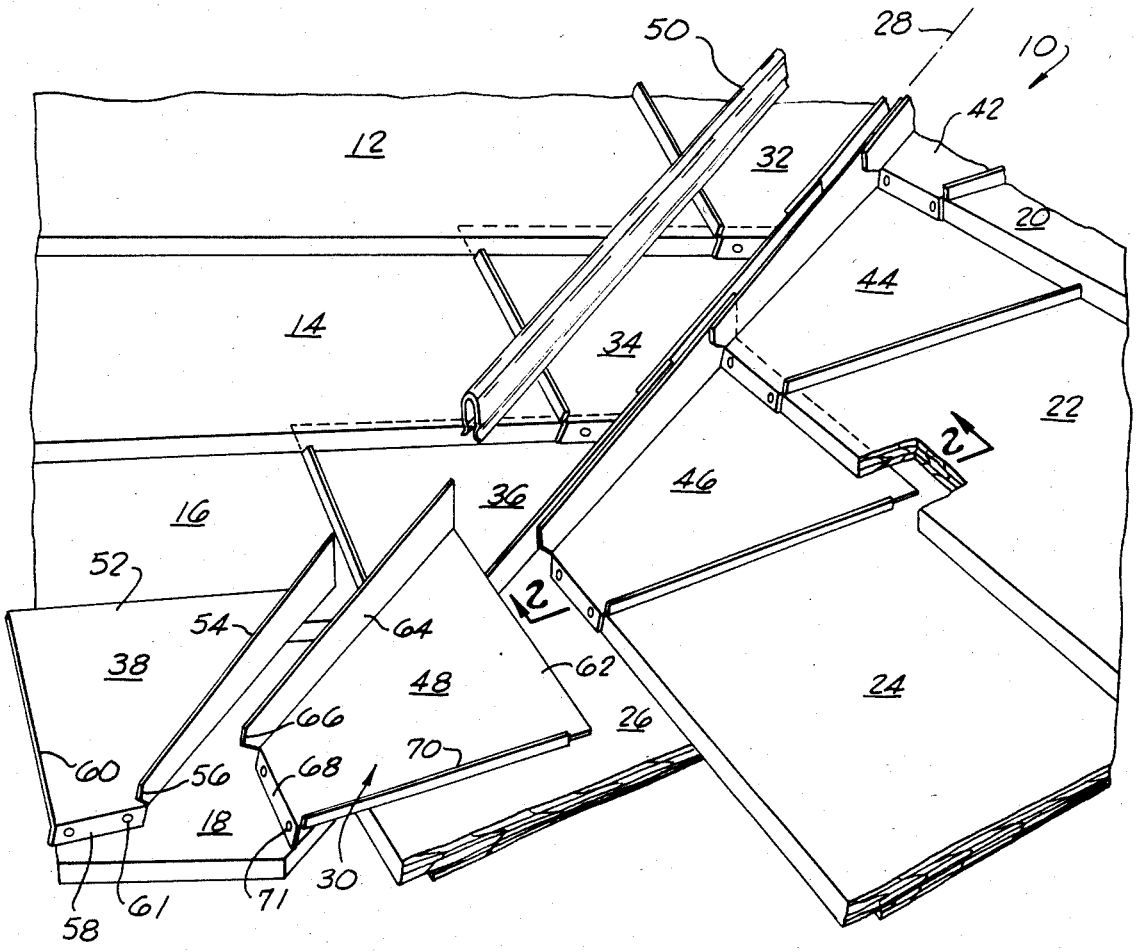
FIG. 1 is a fragmentary perspective, partially exploded, view showing the roof flashing assembly of the invention.

As shown in FIG. 1, a portion of a roof assembly at 10 having rows of Roof Planking at 12, 14, 16, 18, 20, 22, 24 and 26. The dot-line at 28 is a longitudinal plane of the junction of the various rows of planking along the illustrated valley. Flashing assembly 30 is essentially comprised of pairs of mirror-image segments 32 and 42, 34 and 44, 36 and 46, and 38 and 48.

Each segment is identical to corresponding pairs of segments and only one will be described in detail. The combined overlapping sets of segments are covered by a spring-like U-shaped member 50 as shown in FIGS. 1 through 5.

Figure 2:
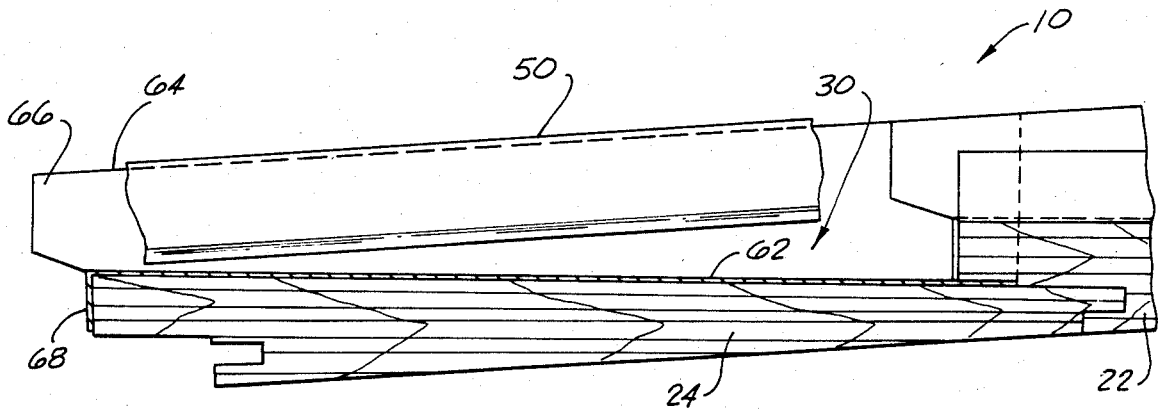
FIG. 2 is an enlarged fragmentary section, partly in elevation, as viewed along the rows 2—2 of FIG. 1.

Roof engaging flat portions 52 and 62 are shown to have upwardly directed elongated walls 54 and 64. These walls are formed integrally with the flat sections 52 and 62, respectively. The uppermost edges of walls 54 and 64 are formed to be parallel to the lower surface of the roof plank as can be seen in FIG. 2, the lower surface of the roof plank is at a slight angle with respect to the upper surface. It can be seen that this upper surface is parallel to the line "a" which is the straight line which is parallel to walls 54 and 64 and which intersects the uppermost edge of roof planks 24 and 22. This creates the design which will at all times keep the upper edges of the walls 54 and 64 at a common height above the plank assemblies whether the rows of planks are in alignment or in misalignment with one another. This design allows easy installation of the connecting sealing strip 50 to surround the wall sections 54 and 64 of their junction. Slight extensions of the walls 54 and 64 are shown at 56 and 66 to allow overlap contact with adjacent surfaces of wall construction of other flashing assemblies. Of course, the lower height of wall 64 should extend upwardly enough to hold U-shaped member 50.

Downwardly extending and integrally formed edge strips or flanges 58 and 68 provide an abutment means against the exposed longitudinal edge of the plank. Openings 61 and 71 are shown as being provided on the downwardly projecting members with the acceptance of appropriate fasteners such as nails, or the like.

Upwardly directed reinforcing ribs 60 and 70 are shown formed integrally with the segments 38 and 48 to help strengthen the structure. These ribs are foreshortened on their upper side to allow the overlapping of adjacent rows of planks.

The connecting and sealing strip 50 is shown as having beaded edges 72 and 74 which are urged in spring-like fashion against the sidewalls 54 and 64 to effect a weather-tight contact between the two. The interconnecting portion 76 of the U-shaped channel prevents any water from entering the seam between elements 38 and 48.

The height H-1 of the upper edge of the strip 50 is such that it is above the water level of the draining stream under downpour conditions. The normal water line in the valley during downpour conditions is shown in FIG. 5 and indicated by reference character 75. It can be seen that even under such downpour conditions that the water level 75 does not exceed the maximum height 77 of the flashing.

Turning to FIG. 7, the flashing assembly 80, as is referred to as prior art, has a maximum height of H-2. The maximum height of the flashing of the left hand segment 82 is indicated by reference character 83 which can be seen to be below the water level 85 occurring during downpour conditions. Thus, it can be seen that water can find its way into the seam 82*a* between flashing segments 82 and 84 because the joint becomes completely submerged under downpour conditions.

The flashing assemblies can be coated with various sealants and protective coatings which are familiar to those versed in such art and can appropriately be galvanized, if desired. This extends the life of the flashing during severe weather conditions and over longer periods of time.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. Roof flashing installed on Roof Planking of the type which will form a weather-proof seal at roof valleys which comprises:

first and second lengths of roofing board each having an upper surface, a lower surface, a front longitudinal edge and an angled intersecting edge, each board having its upper surface at a slight angle with respect to its lower surface;

first and second flashing elements each element having a first flat, roof-engaging surface abutting the upper surface of said one of said lengths of roofing board at the intersecting edge thereof each of said elements having:

an integrally formed, downwardly-directed flange portion along one edge of said flat, roof-engaging surface and normal to said surface sand flange portion abutting said front edge of each of the roofing boards;

an upwardly directed elongated wall portion integrally formed with said flat, roof-engaging surface and at an edge adjacent said downwardly projecting flange portion and said wall portion lying along said intersecting edge of each of said roofing boards, the upper edge of said upwardly directed wall portion is parallel to an imaginary straight line intersecting the front longitudinal edges of adjacent boards and the upwardly directed wall portion of one flashing element abutting the upwardly directed wall portion of the other flashing element, the downward edge of said wall portion extending upwardly a distance sufficient to contact the generally U-shaped attaching element;

an upwardly directed reinforcing wall integrally formed with said flat roof engaging surface at the edge of the flashing element which is opposite the upwardly directed elongated wall portion, said reinforcing wall extending from about said downwardly-directed flange along a majority of the length of edge of the flashing element but terminating at a point removed from the other adjacent edge of the flashing element; and a generally U-shaped attaching element frictionally affixed over the intersection of the two upwardly directed elongated wall portions.

2. The flashing assembly of claim 1 wherein the downwardly directed flange of each element of roof flashing is provided with openings for the receipt of fastening means.

3. The flashing assembly of claim 1 wherein said generally U-shaped attaching element has an elongated pair of bead means which are urged together by a spring-like effect for retaining and sealing said elongated U-shaped attaching element to the upwardly directed elongated wall portions.

4. The roof flashing assembly of claim 1 wherein each of the upwardly directed elongated wall portions extend a sufficient amount toward the direction of the edge having the downwardly directed flange as to allow the upwardly directed elongated wall portions to have an overlaping contact with one another.

* * * * *